US010619886B2

(12) United States Patent
Cermak et al.

(10) Patent No.: US 10,619,886 B2
(45) Date of Patent: Apr. 14, 2020

(54) AIRFOIL DAMPER

(71) Applicant: ACME ENGINEERING AND MANUFACTURING CORP., Muskogee, OK (US)

(72) Inventors: Jan Cermak, Tulsa, OK (US); Darrell Dotson, Tulsa, OK (US)

(73) Assignee: ACME ENGINEERING AND MANUFACTURING CORP., Muskogee, OK (US)

( * ) Notice: Subject to any disclaimer, the term of this patent is extended or adjusted under 35 U.S.C. 154(b) by 85 days.

(21) Appl. No.: 15/272,498

(22) Filed: Sep. 22, 2016

(65) Prior Publication Data

US 2017/0097171 A1 Apr. 6, 2017

Related U.S. Application Data

(60) Provisional application No. 62/247,982, filed on Oct. 29, 2015, provisional application No. 62/235,985, filed on Oct. 1, 2015.

(51) Int. Cl.
*F24F 13/15* (2006.01)
*F24F 13/14* (2006.01)
(Continued)

(52) U.S. Cl.
CPC ..... *F24F 13/15* (2013.01); *F04D 25/14* (2013.01); *F24F 7/013* (2013.01); *F24F 11/745* (2018.01);
(Continued)

(58) Field of Classification Search
CPC ..... F24F 13/15; F24F 13/075; F24F 13/1426; F24F 13/1486; F24F 7/013; F24F 11/745; F04D 25/14
(Continued)

(56) References Cited

U.S. PATENT DOCUMENTS 1,706,280 A * 3/1929 Dyer ..... F24F 13/15 110/175 A
1,793,802 A * 2/1931 Hinton ..... F23L 11/02 110/175 A
(Continued)

OTHER PUBLICATIONS

Greenheck, "Actuators for Commercial HVAC Dampers (DA/101-02)," http://www.greenheck.com/library/articles/39, Jun. 1, 2002, printed Sep. 9, 2016, 5 pages.
(Continued)

*Primary Examiner* — Steven B McAllister
*Assistant Examiner* — Allen R Schult
(74) *Attorney, Agent, or Firm* — Staas & Halsey LLP

(57) ABSTRACT

A fan damper includes a frame and a plurality of hollow airfoil blades, each having a leading edge, a trailing edge, a seal on the trailing edge, and a pivot mechanism on either end of each blade, including an extension having a weight. A secondary seal is positioned between the pivot mechanisms and the sides of the frame. A ladder bar connects the pivot mechanisms. During significant air pressure changes, the blades move against the weights from a first, closed, overlapping position, whereupon the seal on the trailing edge of a relatively upper blade seals against the leading edge of an adjacent relatively lower blade, and the secondary side frame seal seals against the pivot mechanisms, to a second, open position. When the air pressure decreases sufficiently, the blades return to the closed, overlapping position.

12 Claims, 14 Drawing Sheets

(51) Int. Cl.

| | |
|---|---|
| ***F24F 11/74*** | (2018.01) |
| ***F04D 25/14*** | (2006.01) |
| ***F24F 7/013*** | (2006.01) |
| ***F24F 13/075*** | (2006.01) |

(52) U.S. Cl.
CPC ..... *F24F 13/075* (2013.01); *F24F 13/1426* (2013.01); *F24F 13/1486* (2013.01); *F24F 2221/17* (2013.01)

(58) Field of Classification Search
USPC ..... 454/278
See application file for complete search history.

(56) References Cited

U.S. PATENT DOCUMENTS

| | | | | |
|---|---|---|---|---|
| 1,973,997 | A * | 9/1934 | Roberts | F23L 11/02 110/173 B |
| 2,623,581 | A | 12/1952 | Nelson | |
| 2,697,487 | A | 12/1954 | Nelson | |
| 2,716,786 | A * | 9/1955 | Moore | E06B 7/084 49/403 |
| 3,110,936 | A | 11/1963 | Berard | |
| 3,698,429 | A * | 10/1972 | Lowe | F16K 1/165 137/601.06 |
| 4,083,150 | A | 4/1978 | Smith | |
| 4,189,121 | A | 2/1980 | Harper et al. | |
| 4,263,842 | A * | 4/1981 | Moore | F24F 13/15 415/115 |
| 4,334,389 | A | 6/1982 | Visser | |
| 4,341,344 | A | 7/1982 | Russell | |
| 4,516,354 | A | 5/1985 | Dugan | |
| RE32,339 | E | 1/1987 | Jones et al. | |
| 4,709,506 | A | 12/1987 | Lukaszonas | |
| 4,736,677 | A | 4/1988 | Smith | |
| 4,744,290 | A | 5/1988 | Josephson | |
| 5,001,864 | A | 3/1991 | Truscott | |
| 5,159,783 | A | 11/1992 | Rossiter | |
| 5,179,802 | A | 1/1993 | Higton | |
| 5,183,390 | A | 2/1993 | Amos | |
| 5,191,735 | A | 3/1993 | Ross | |
| 5,238,453 | A | 8/1993 | Heil | |
| 5,293,920 | A | 3/1994 | Vagedes | |
| 5,303,507 | A | 4/1994 | Oille | |
| 5,560,147 | A | 10/1996 | Ashida et al. | |
| 5,572,831 | A | 11/1996 | Rafiqui | |
| 5,630,295 | A | 5/1997 | Neiman | |
| 5,778,598 | A | 7/1998 | Ohanesian | |
| 5,794,380 | A | 8/1998 | Guardia | |
| 5,887,386 | A | 3/1999 | Alexanian et al. | |
| 5,915,960 | A | 6/1999 | Check et al. | |
| 5,921,028 | A | 7/1999 | Marocco | |
| 5,924,255 | A | 7/1999 | Vagedes | |
| 5,941,021 | A | 8/1999 | Valls, Jr. et al. | |
| 6,030,179 | A | 2/2000 | McCabe | |
| 6,039,533 | A | 3/2000 | McCabe | |
| 6,041,547 | A | 3/2000 | Marocco | |
| 6,098,340 | A | 8/2000 | Francis | |
| 6,190,122 | B1 | 2/2001 | McCabe | |
| D442,272 | S | 5/2001 | Gabriele | |
| 6,226,922 | B1 | 5/2001 | Swapp | |
| D443,701 | S | 6/2001 | Gabriele | |
| D445,511 | S | 7/2001 | Gabriele | |
| 6,263,632 | B1 | 7/2001 | Cadorette | |
| 6,386,828 | B1 | 5/2002 | Davis et al. | |
| 6,401,391 | B2 | 6/2002 | Gabriele | |
| 6,418,665 | B1 | 7/2002 | Gabriele | |
| 6,536,162 | B2 | 3/2003 | LaMay | |
| 6,601,353 | B2 | 8/2003 | Gabriele | |
| 6,602,014 | B2 | 8/2003 | Lee | |
| 6,616,404 | B1 | 9/2003 | Davis et al. | |
| 6,655,091 | B1 | 12/2003 | Iwasaki | |
| D498,000 | S | 11/2004 | Griffiths | |
| 6,810,621 | B1 | 11/2004 | Ricci | |
| 6,810,620 | B1 | 12/2004 | Anderson et al. | |
| 6,863,245 | B2 | 3/2005 | Gessler et al. | |
| 6,953,320 | B1 | 10/2005 | Davis et al. | |
| 7,018,289 | B2 | 3/2006 | Heil et al. | |
| 7,082,719 | B2 | 8/2006 | Regnery | |
| 7,104,010 | B2 | 9/2006 | Winner | |
| 7,354,246 | B2 | 4/2008 | Malone et al. | |
| 7,363,748 | B2 | 4/2008 | Gabriele | |
| D569,994 | S | 5/2008 | Platta et al. | |
| 7,510,778 | B2 | 3/2009 | Bernard et al. | |
| 7,716,884 | B2 | 5/2010 | Jaycox | |
| 7,921,602 | B2 | 4/2011 | Ohanesian | |
| 7,963,071 | B2 | 6/2011 | Alexander et al. | |
| 8,082,693 | B2 | 12/2011 | Marocco | |
| 8,091,281 | B1 | 1/2012 | Blachley | |
| 8,156,688 | B2 | 4/2012 | Tan | |
| 8,161,682 | B2 | 4/2012 | Marocco | |
| 8,281,518 | B2 | 10/2012 | Marocco | |
| 8,312,676 | B2 | 11/2012 | Maciulewicz | |
| 8,336,256 | B2 | 12/2012 | Jeffrey et al. | |
| 8,371,813 | B2 | 2/2013 | Tsai et al. | |
| 8,418,967 | B2 | 4/2013 | Hemmelgarn et al. | |
| 8,474,187 | B2 | 7/2013 | Marocco | |
| 8,533,996 | B1 | 9/2013 | Stone | |
| 8,650,801 | B2 | 2/2014 | Ayshford et al. | |
| 8,672,649 | B2 | 3/2014 | Smith et al. | |
| 8,678,324 | B2 | 3/2014 | Hemmelgarn et al. | |
| 8,782,951 | B2 | 7/2014 | Dickison | |
| 8,783,741 | B2 | 7/2014 | Marocco | |
| 8,826,593 | B2 | 9/2014 | Baek | |
| 8,857,106 | B2 | 10/2014 | Colson | |
| 8,974,184 | B2 | 3/2015 | Becker et al. | |
| 9,011,099 | B2 | 4/2015 | Wortman et al. | |
| 9,021,743 | B2 | 5/2015 | Piermee | |
| 9,033,283 | B1 | 5/2015 | Hemmelgarn et al. | |
| 2002/0076325 | A1 | 6/2002 | Fink et al. | |
| 2006/0275626 | A1 | 12/2006 | Bernard et al. | |
| 2006/0286924 | A1 | 12/2006 | Milana | |
| 2009/0084131 | A1 | 4/2009 | Reifel et al. | |
| 2009/0193657 | A1 | 8/2009 | Wilson, Jr. et al. | |
| 2009/0252608 | A1 | 10/2009 | Metivier | |
| 2010/0024340 | A1 | 2/2010 | Claywell et al. | |
| 2012/0273617 | A1 | 11/2012 | Jensen | |
| 2013/0142681 | A1 | 6/2013 | Bacon et al. | |
| 2013/0145753 | A1 | 6/2013 | Becker et al. | |
| 2015/0135696 | A1 | 5/2015 | Becker et al. | |

OTHER PUBLICATIONS

National Aeronautics and Space Administration ("NASA"), "Shape Effects on Lift", Glenn Research Center https://www.grc.nasa.gov/www/k-12/airplane/shape.html, "last updated Apr. 5, 2018", downloaded Sep. 7, 2018, 3 pages.

Wikipedia, "Airfoil", https://en.wikipedia.org/wiki/Airfoil, Jul. 18, 2018, downloaded Aug. 3, 2018, 8 pages.

NASA, NACA Airfoils, https://www.nasa.gov/image-feature/langley/100/naca-airfoils, dated Jul. 31, 2017, downloaded Aug. 7, 2017, 2 pages.

Google Images, "nasa airfoil", https://www.google.com/search?g=nasa+airfoil&tbm=isch&tbo=u&source=univ&sa=X&ved=2ahUKEwibjfLu1tvcAhVFeawKHaWFARAQsAR6BAgDEAE&biw=1600&bih=732, downloaded Aug. 7, 2018, 6 pages.

Declaration of inventor Jan Cermak with Exhibits A-C, dated Aug. 7, 2018, 26 pages.

* cited by examiner

AIRFOIL DAMPER

CROSS REFERENCE TO RELATED APPLICATIONS

This application claims the benefit under 35 U.S.C. Section 119 of U.S. Patent Application Ser. No. 62/235,985, filed Oct. 1, 2015, entitled "Airfoil Damper", and of U.S. Patent Application Ser. No. 62/247,982, filed Oct. 29, 2015, entitled "Airfoil Damper", which are hereby incorporated by reference in their entireties into this application.

BACKGROUND OF THE INVENTION

1. Field of the Invention

This invention relates to building ventilation and, more particularly, to a damper used in a wall of a building to control air movement through the building.

2. Description of the Related Art

In large buildings, such as agricultural or industrial buildings, there are often employed large electric fans to move air through the building. Louvers, shutters or dampers are installed in the walls of the buildings adjacent the large fans. The damper is open when the fan is on to allow air movement through the damper and closed when the fan is off, thereby preventing hot or cold exterior air from entering the building.

These conventional dampers are opened and closed by electric motors to coordinate with the on/off operation of the electric fans. Of course, the need for electric motors requires extra maintenance for the motor, extra cost for the motor and the electrical system for the motor, extra use of electricity to power the motor, etc.

SUMMARY OF THE INVENTION

Accordingly, it is a purpose of the present invention to provide a damper which is more economical, cost-effective, and reliable, and which can open and close automatically without the need for an electric motor.

It is another purpose of the present invention to provide a damper that does not require electric motor operation.

It is another purpose of the present invention to provide a damper that helps prevent hot or cold air from penetrating through a closed damper.

It is another purpose of the present invention to provide a damper using hollow blades that have a relatively high "R" (insulation) value for energy efficiency.

It is still another purpose of the present invention to provide a damper providing a superior seal between the blades, and between the blades and a frame for the blades.

It is another purpose of this invention to provide a blade that has seals along the trailing edge thereof to provide a tight seal when the damper is in the closed position.

It is another purpose of the present invention to provide damper blades in an airfoil shape to help provide lift to open the damper via a change in air pressure.

It is further a purpose of the present invention to provide a blade that has a pivot point closer to a leading edge of the blade, which allows a pressure differential across the damper to help the damper open on its own, without the need for motorization.

It is yet another purpose of the present invention to provide a ladder bar to connect each blade to all other blades of the damper to create more uniform opening and closing motions.

Finally, it is another purpose of the present invention to provide blades that have end caps with an extension on a leading edge side thereof, and weights on the extensions which must be counteracted by the air pressure in order to open the damper.

To achieve the foregoing and other purposes of the present invention there is provided a damper having an open frame in which is arranged a plurality of aerodynamic vanes or blades that move together automatically based on air pressure changes.

The blades move from an open position, wherein the blades are spaced from each other and air moves through the damper between the blades, to a closed position, wherein the top and bottom edges of adjacent blades (except the uppermost and lowermost blades) overlap via seals, and the sides of the frame are sealed, so that air is essentially prevented from moving through the damper. With the uppermost blade, an upper (leading) edge is received by the top of the frame and a lower (trailing) edge overlaps the next adjacent blade upper edge. With the lowermost blade, a lower (trailing) edge is received by the bottom of the frame and an upper (leading) edge overlaps the next adjacent blade lower (trailing) edge.

Plural such dampers can be arranged adjacent to each other to provide a larger amount of airflow and/or to provide selective opening and closing of respective dampers.

The damper is part of a ventilation system which minimizes air leakage and energy loss relative to conventional ventilation systems incorporating dampers.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION

Figure 1A:
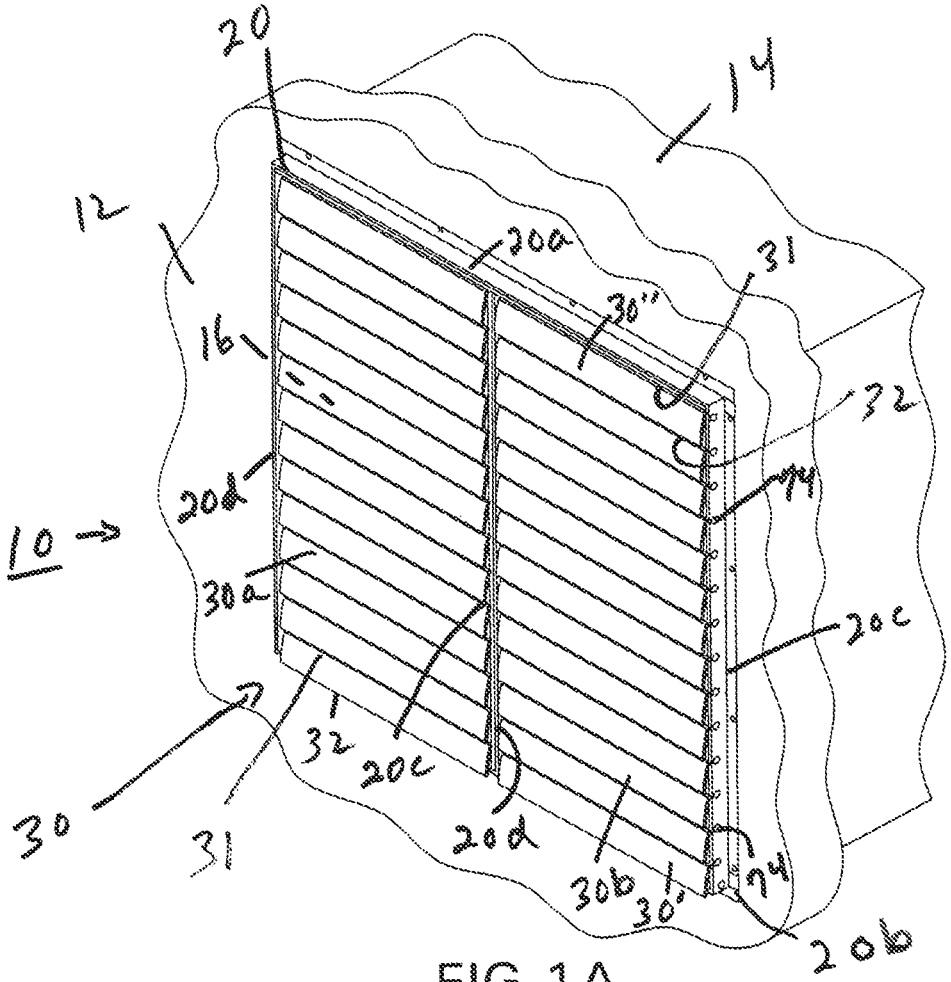
FIG. 1A is a perspective view of a damper according to the present invention.

FIG. 1A is a perspective view of a damper 10 according to an embodiment of the present invention received within an exterior wall 12 of a building and adjacent an electric fan 14 that introduces air into a building.

In the embodiment shown, there is one damper 10 having two side-by-side sets 30*a* and 30*b* of blades 30. Of course, only one set of blades 30 may be used in a damper 10, there may be more than two sets of blades 30 per damper 10, or a plurality of dampers 10 can be located throughout a building, each frame having one or more sets of blades.

The one or more dampers 10 are a part of a larger ventilation system employing one or more conventional electric fans 14. The one or more dampers 10 minimize air leakage when respective associated fans 14 to which the one or more dampers 10 are attached are off and allow for low energy losses when the associated fans 14 are operating.

Plural such dampers 10 can be arranged adjacent to each other in the wall 12 to provide a larger amount of airflow and/or to provide selective opening and closing of respective dampers 10.

The damper 10 generally includes a support or frame 20 and one or more vanes or blades 30 arranged horizontally within the frame 20.

As described below, the damper 10 also includes pivot mechanisms 60 having blade end pieces or end caps 70, 71 and ballast brackets 80, 81, as well as counter-weights 100, and a ladder bar 110.

The frame 20 is preferably rectangular and defines an opening 16 between top, bottom and right and left side portions 20*a*-20*d*, respectively. The two vertical sides 20*c* and 20*d* may be longer than the horizontal bottom/top.

In the embodiment shown in FIG. 1A, two sets 30*a* and 30*b* of blades 30 are separated at a vertical middle. In this embodiment, the frame 20 would include two right sides 20*c* and two left sides 20*d*, with the two innermost sides 20*c* and 20*d* being adjacent each other.

The frame 20 should have outer dimensions like a traditional building wall damper and is intended to replace such a traditional damper to provide improved energy efficiency, ease of operation and maintenance. Of course, the damper 10 of this invention can be used in new building construction, in addition to replacement of conventional motor operated dampers.

The blades 30 move together in the frame 20, like a shutter, via the pivot mechanisms 60 and ladder bars 110 described below.

Figure 1B:
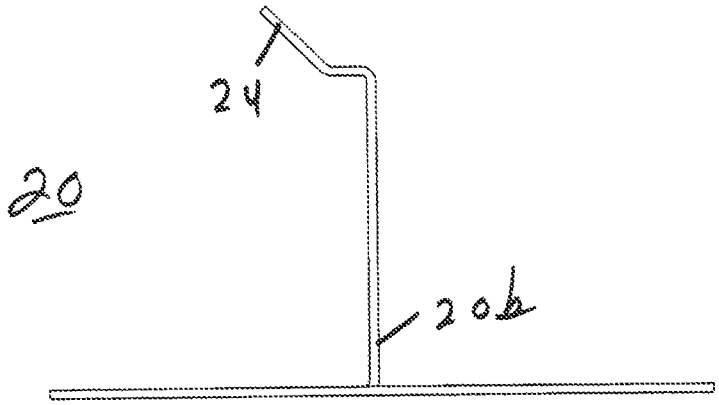
FIG. 1B is a side, cross-sectional view of a bottom member of the frame.

As shown in FIG. 1B, the frame bottom 20*b* preferably includes an angled upper portion 24 upon which a trailing edge 32 of a lowermost blade 30' seals against when the blades 30 are in the closed position. This creates a complementary surface for the blade 30' to rest upon and therefore a better closed interface between the lowermost blade 30' and the frame bottom 20*b*. As described below, each trailing edge 32 includes a seal 42. By this interface, there is less air and light leakage through the damper 10, when the blades 30 are in the closed position.

Figure 2:
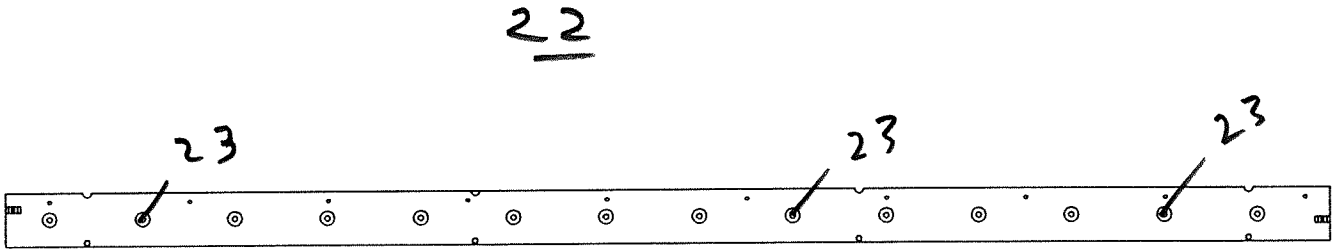
FIG. 2 is a plan view of a left side frame piece of the present invention, illustrating particularly holes formed therein to receive the ends of the blades.
Figure 3:
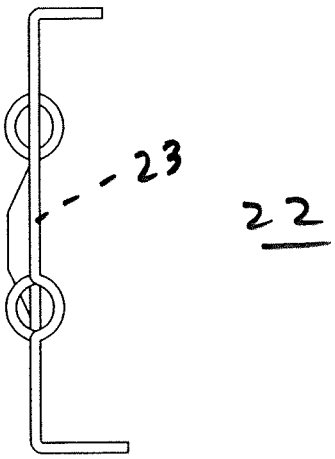
FIG. 3 is a side view of the frame piece shown in FIG. 2.

FIGS. 2 and 3 show a left side frame piece 22. As shown therein, as with a conventional damper frame, the vertical sides 20*c* and 20*d* include a plurality of equally spaced holes 23. These holes 23 receive pivot pieces 74, described below, on the end caps 70, 71 of the blades 30. These holes 23 can be formed directly in the sides 20*c* and 20*d* of the frame 20 or in separate members attached to the frame 20.

An exemplary number of holes, i.e., fourteen, is shown in FIG. 2. These holes 23 would be formed correspondingly on both sides 20*c* and 20*d* of the frame 20 to receive the respective pivot pieces 74 on the ends of the fourteen blades 30. Of course, any numbers of blades 30, including a single blade, can be used with the frame 20, although a plurality is the most likely.

The frame 20 is preferably metal, such as aluminum, but could be plastic or wood. In any case, the material must be durable, as the damper will likely be exposed to the elements, and should be structurally sturdy so as to be able to support reliably the other components of the damper 10 described herein, and to be attached to the wall 12.

Figure 4:
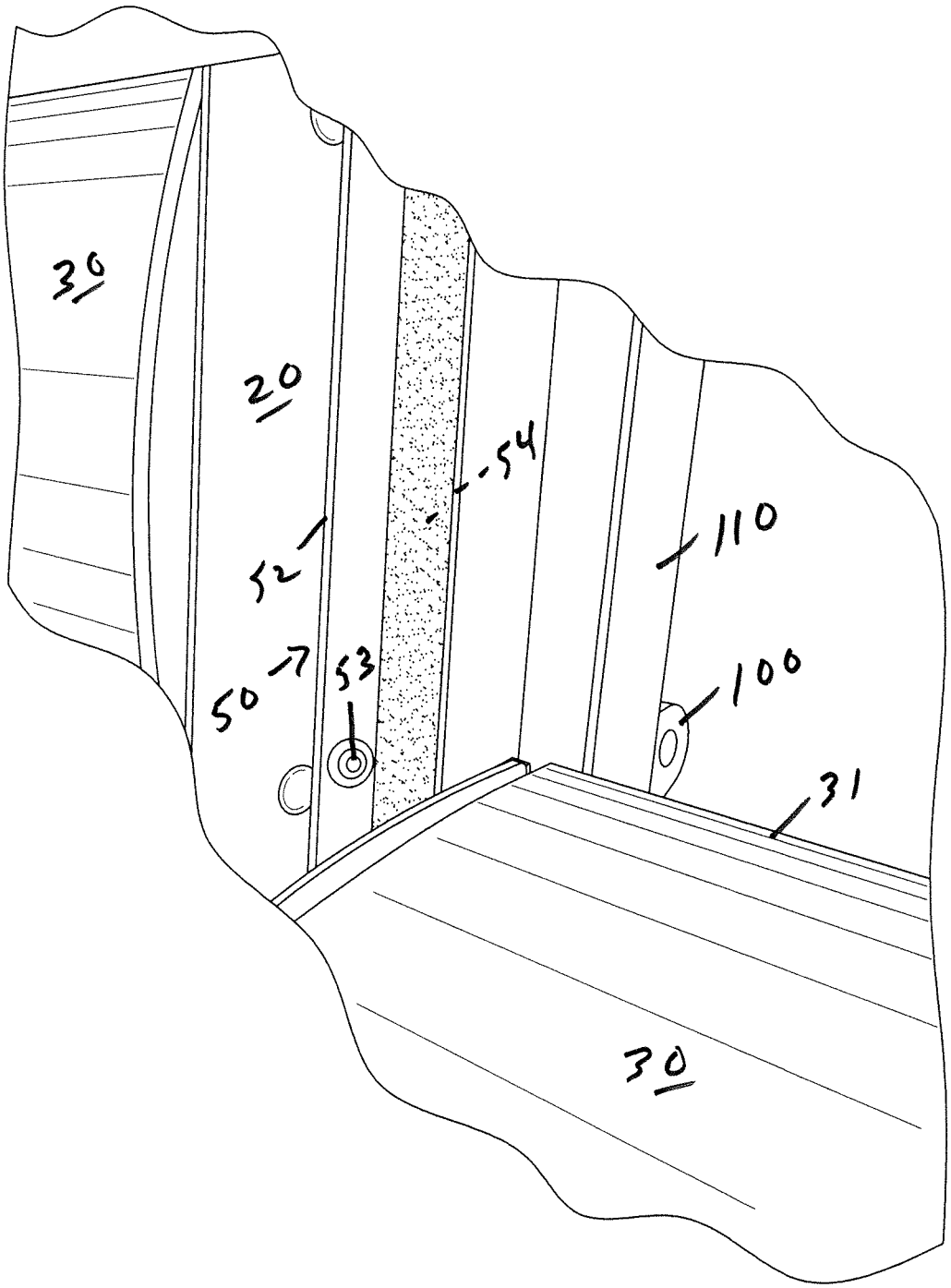
FIG. 4 is a perspective view of the frame.

As shown in FIG. 4, the damper 10 may include seals 50 along preferably the insides of the right side 20*c* and left side 20*d* of the frame 20. These seals 50 provide a low friction surface between the ends of the blades 30 and the frame 20 to facilitate movement of the blades 30 relative to the frame 20. These seals 50 also help prevent air and light leakage at the interface of the leading 31 and trailing edges 32 of the uppermost 30" and lowermost 30' blades, and along the top 20*a* and bottom 20*b*, respectively, of the frame 20, and between the two end caps 70, 71 of each of the blades 30 along the right and left sides 20*c* and 20*d* of the frame 20.

The seals 50 preferably include fiber seals or strips 54, such as a felt material. Of course, other materials could be used, such as a brush-like or rubber seal. In any case, the material used should help prevent air and light movement across the interface, not impede rotation of the blades 30 relative to the frame 20, and be durable enough to withstand many opening and closing cycles of the damper 10.

As also shown in FIG. 4, the seals 50 may be received in a plastic, elongated retainer 52 affixed to the insides of the frame 20 by, e.g., attachments 53 like rivets, screws or even adhesive. Alternatively, the felt seals 54 can be attached directly to the frame, by, e.g., rivets, screws, adhesive, etc.

As noted above, these seals 50 seal against the end caps 70, 71 of the blades 30 described below, and edges 31, 32 of the blades 30 to reduce air and light leakage and improve energy efficiency. Thus, in addition to the improved thermal efficiency of the damper 10 due to the construction of the blades 30 discussed below, such efficiency is further enhanced by the use of these seals 50 between the blades 30 and the frame 20.

Figure 5:
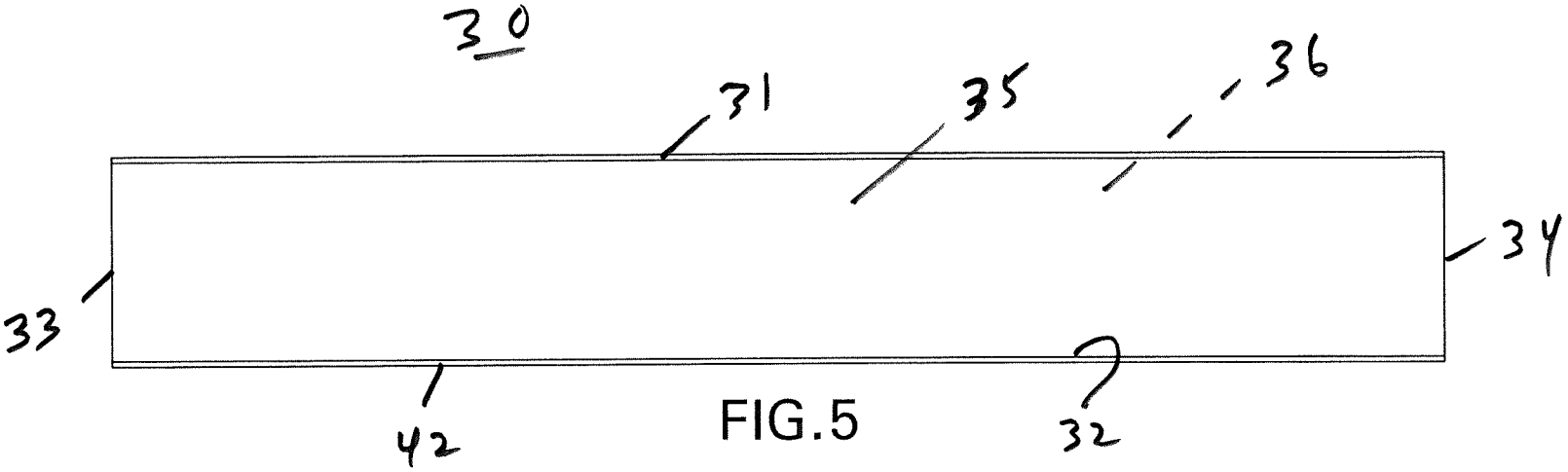
FIG. 5 is a top view of a blade according to the present invention.

FIG. 5 is a top view of a blade 30 according to a preferred embodiment of the present invention, without the end caps 70, 71 or ballast brackets 80, 81 which are described below.

Figure 6:
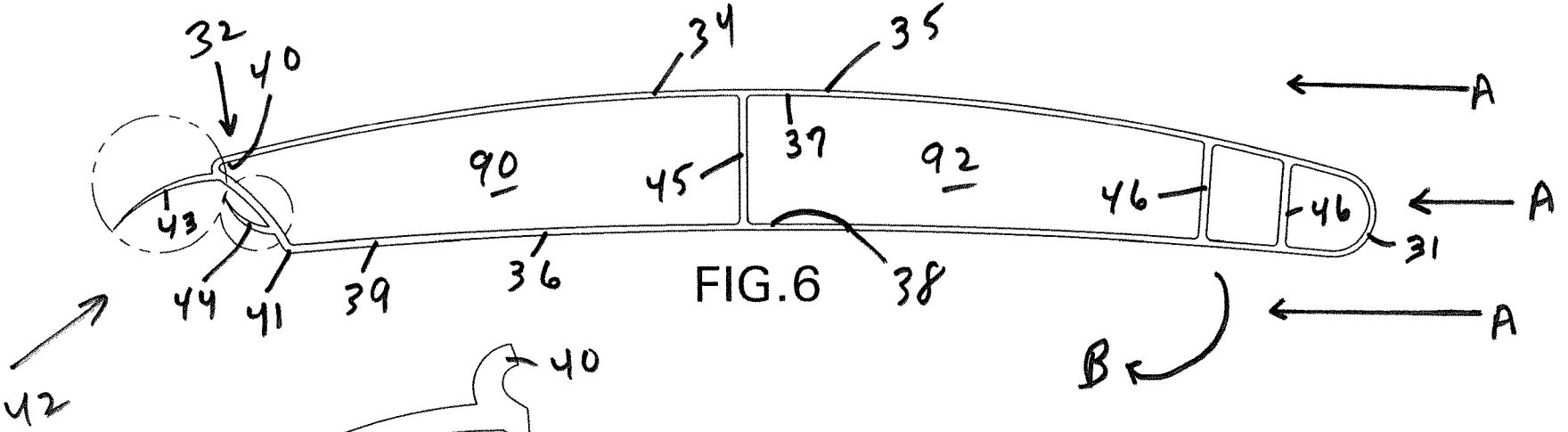
FIG. 6 is an right end view of the blade shown in FIG. 5, illustrating particularly the ribbed internal reinforcement, the leading edge and the trailing edge with two seals.
Figure 9:
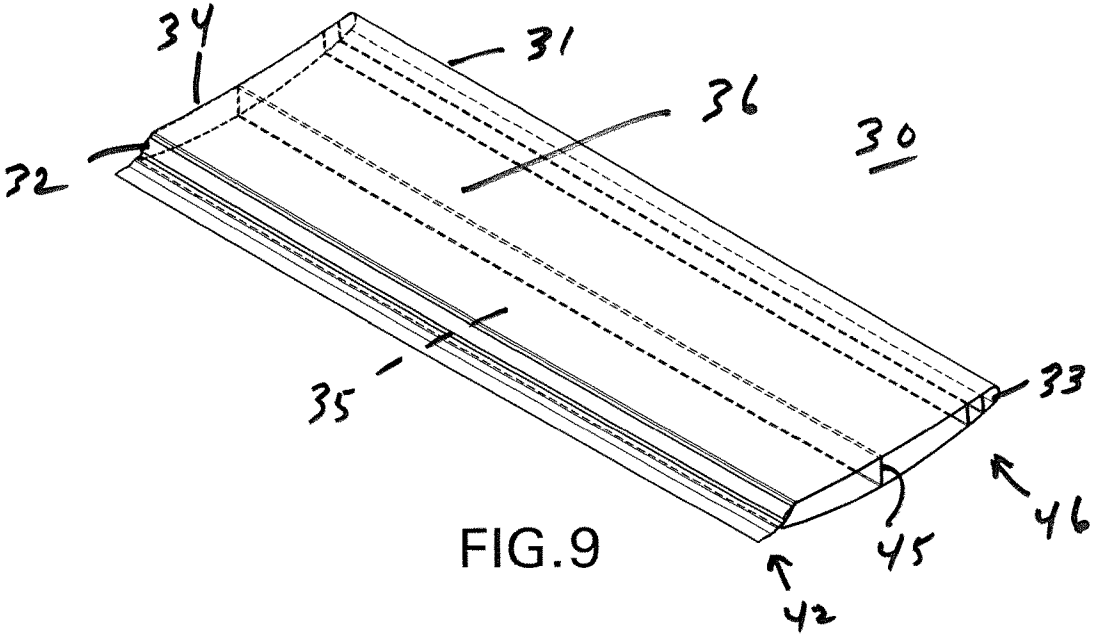
FIG. 9 is a bottom perspective view of the blade shown in FIG. 6, illustrating particularly ribbed internal reinforcement.

As shown in FIGS. 5, 6 and 9, each blade 30 is a wing-like or airfoil member. Of course, an airfoil includes a surface that aids in lifting the airfoil via the air currents moving therealong. That is, the blade 30 has an aerodynamic profile designed to achieve high lift and low drag, i.e., to help provide lift to move the damper 10 to the open position from the closed position, and still have the necessary structural properties to operate at high face velocities, and under a pressure difference when the damper 10 is closed.

More particularly, each blade 30 is an elongated member with first and second longitudinal edges, i.e., the leading edge 31 and the trailing edge 32, extending between two opposite ends, left end 33 and right end 34, a top 35 and a bottom 36. A seal 42, discussed below, is included in the trailing edge 42.

FIG. 6 is a right end 34 view of the blade 30. Preferably the blade 30 is extrusion molded of a suitable plastic that is durable enough to keep its shape under various air temperature and moisture conditions, and air pressures. An example of such a material is exterior grade polyvinylchloride plastic.

The blade 30 has a hollow core 37 with a central rib 45 extending longitudinally along the blade 30, as described further below.

The following dimensions are for illustrative purposes only and are not intended to limit the invention. The blade 30 may about 4.337 inches wide from the leading edge 31 to the trailing edge 32, and about 0.414 inches thick from the top 35 to the bottom 36 along a middle 38 thereof. A radius of the top 35 is about 7.496 inches and a radius of the bottom is about 21.453 inches. The thickness of the wall 39 making up the blade 30 is about 0.024 of an inch. The radius of the leading edge 31 is about 0.15 inches At the trailing edge 32, upper and lower corners 40 and 41 have a radius of about 0.041. The overall length of a blade 30, from end to end, may be about 60 inches.

This airfoil-shapes blade 30 allows air to flow through the opening 16 defined by the frame 20, when the blades 30 are not parallel with the frame 20, but doesn't allow the air flow through the opening 16, when the blades 30 are parallel with the frame 20.

When air pressure on a discharge side of the damper 10 is greater than the air pressure on an inlet side of the damper 10, the blades 30 close, preventing any movement of air across the sealed damper 10. When the pressure on the inlet side (leading edges 31 of the blades 30) becomes greater than the pressure on the discharge side, the airfoil shape of the blades allows the blades 30 to begin to rotate open (against the counter-weights 100 discussed below) and allow the air to flow through the damper 10. That is, as the air flow velocity across the blades 30 increases, the air enveloping each blade 30 starts to create a lifting force that begins opening the blades 30 until equilibrium is achieved between the lifting force of the air and the gravitational forces on the blade 30.

More particularly, air pressure "A" moving against the leading edge 31 of each blade 30 causes the blade 30 to rotate (see arrow "B") from a closed, overlapping, essentially vertical state (see FIG. 1A) to the essentially horizontal, non-overlapping state shown in FIG. 6 against the counter balance of the weights 100 described below. The airfoil profile of the blade 30 facilitates movement of the air pressure "A" along the blade 30 and helps keep the blade 30 in the horizontal state, as long as the air pressure "A" is exerted against the airfoil shape.

No motorization is usually necessary to open/close the blades 30, as the damper 10 opens and closes automatically due to air pressure differences. Nonetheless, the damper 30 can be motorized, if desired, e.g., when used for air supply instead of air exhaust.

As best shown in FIGS. 6-9, extending along the trailing edge 32 of each blade 30 is a seal 42 that is preferably co-extruded with the blade 30. The seal 42 is preferably formed of first and second seal parts 43 and 44, respectively, running along the trailing edge 32. When the blades 30 are in the closed position, the double seal 42 on the trailing edge 32 of an upper blade 30 presses against the leading edge 31 of a lower, adjacent blade 30 except for the lowermost blade 30' (described above and as shown in FIG. 1B) to substantially seal the interface of two overlapping blades 30 against air movement and light transmission.

Figure 7:
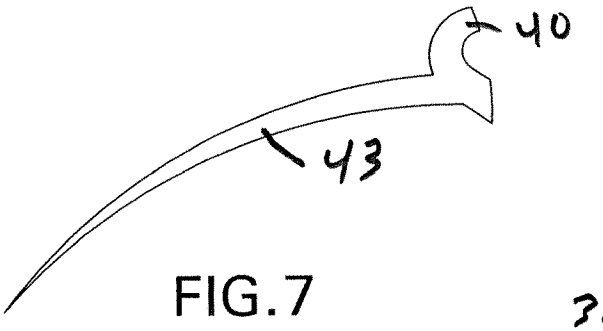
FIG. 7 is an enlarged view of a first one of the seals on the trailing edge of the blade shown in FIG. 6.

FIG. 7 is an enlarged view of the first seal part 43 on the trailing edge 32 of the blade 30 shown in FIG. 6. This first seal part 43 is curved and preferably extends outwardly and downwardly from an upper portion of the trailing edge 32. In an exemplary embodiment, the overall length of this seal part 43 is about 0.412 of an inch.

Figure 8:
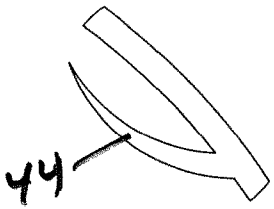
FIG. 8 is an enlarged view of a second one of the seals on the trailing edge of the blade shown in FIG. 7.

FIG. 8 is an enlarged view of the second seal part 44 on the trailing edge 32 of the blade 30 shown in FIG. 6. This second seal part 44 is preferably shorter (in an exemplary embodiment, about 0.159 inch) than the first seal part 43 and curves back toward the trailing double edge 32. The second seal part 44 curves toward the blade 30 so that when in the closed position, the seal 42 will easily and reliably contact the blade 30 below (or wall 24 as the case may be). This will ensure that the blades 30 all contact when in the closed position, eliminating any light penetration and reducing air migration across the damper 10.

The two seal parts 43, 44 can be made of, e.g., a low durometer rubber or nylon, and are preferably co-extruded with the blade 30. Alternatively, the seals 43, 44 can be formed individually, or together, and attached to the trailing edge 32 of the blade 30 via a channel (not shown) formed in the trailing edge, or by adhesive, rivets, screws, etc.

FIGS. 6 and 9 also show the ribbed internal reinforcement of the blade 30. That is, the hollow core 37 of each blade 30 includes internal reinforcing ribs 45, 46 that preferably extend along the length of, and provide structural integrity to, the hollow blade 30.

Preferably one of the ribs 45 extends approximately along the central axis "C" of the elongated blade 30 and a pair of the ribs 46 extends along at least one edge of the blade 30, preferably the leading edge 31.

As shown in FIGS. 10-17, the present invention also includes a plurality of pivot mechanisms 60 that close the ends of the blades 30 and basically include end caps 70, 71 and a ballast brackets 80, 81, as described below. Each pivot mechanism 60 is pivotably connected to a ladder bar 110, described below, and to the holes 23 in the frame 20 via the pivot pieces 74.

Figure 10:
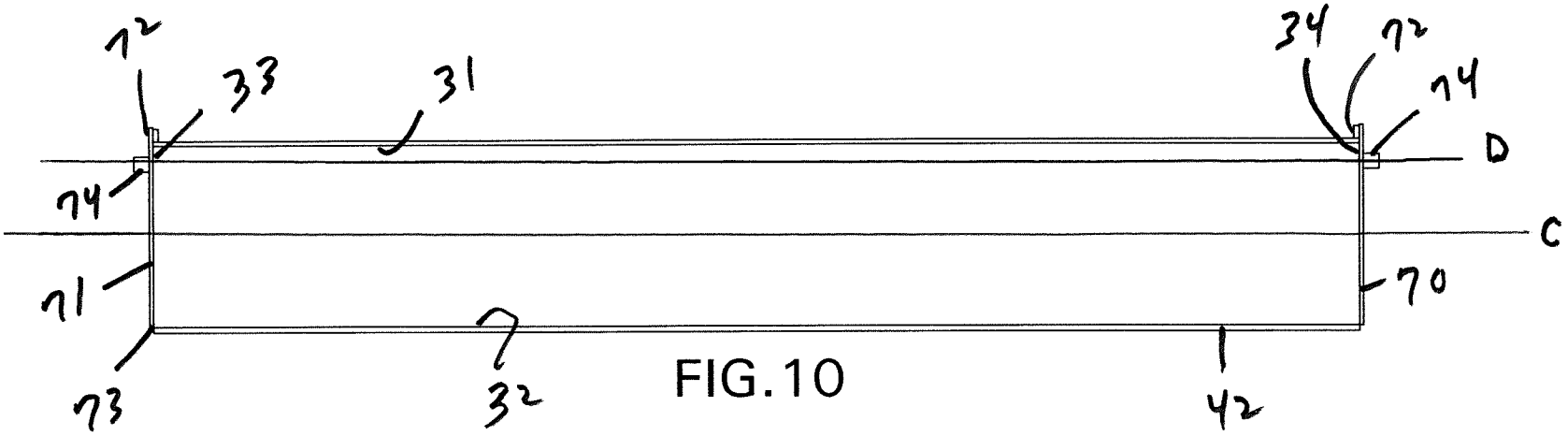
FIG. 10 is a top view of a blade with end caps attached to either end.
Figure 11:
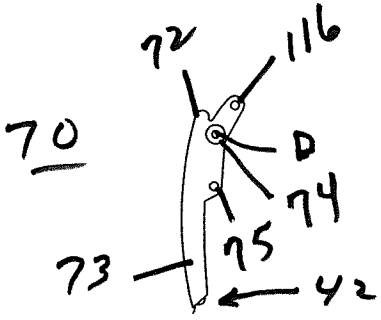
FIG. 11 is a right side view of the blade shown in FIG. 10.

FIG. 10 is a top view of a blade 30 with right and left end caps 70, 71, attached to the respective right and left ends 34 and 33, respectively, of each blade 30. FIG. 11 is a side view of the right end cap 70 shown in FIG. 10. The left end cap 71 is essentially a mirror image of the right end cap 70 so only the right end cap 70 is described below.

As shown in FIGS. 10 and 11, the right end cap 70 is an elongated member having a leading end 72 and a trailing end 73. The end cap 70 includes a pivot piece 74, e.g., a bushing or pin, toward the leading edge 72 and projecting outwardly relative to from the blade 30. That is, preferably an axis of rotation "D" of the blade 30 is between the central axis "C" of the blade 30 and the leading edge 31 of the blade 30, and more preferably relatively close to the leading edge 31.

Since each blade 30 has a pivot point defined by the projecting pivot piece 74 that is closer to the leading edge 31 of the blade 32, this allows for a pressure differential across the damper 10 to help the blades 30 begin to open on their own under air pressure, as described herein, along the axis "D" parallel with the leading 31 and trailing 32 edges of the blade 30. Thus, unlike the conventional dampers, no electric motor is required to open and close the blades 30 on the damper 10, according to the present invention.

The end cap 70 may also include holes 75 to connect the end cap 70 to a ballast bracket discussed below.

Each end cap 70, 71 is preferably separately injection molded from plastic and inserted into the hollow opposite ends 33 and 34 of each blade 30 to close the hollow blade 30. That is, as shown particularly in FIGS. 16 and 17, the inner side of each end cap 70, 71 preferably includes two projecting portions 76, 77, each of which is received by a respective hollow portion 92, 90 of the blade 30. The projecting portions 76, 77 are separated by a space 78 that corresponds to the central rib 45 that separates the hollow, trailing portion 90 and the hollow leading portion 92 of the blade 30 (see FIG. 6).

The end caps 70, 71 may be held to the blades 30 by ribs 68 formed on the outside of walls forming the projecting portions 76, 77. These ribs 68 provide outward force on the inside of the walls 39 of the blade 30. That is, the end caps 70, 71 can be attached to the open ends 33, 34 of the blades 30 via an interference fit between the ribs 68 and receptacles 86, as described below. Basically, each end cap 70, 71 is merely inserted and snapped into the open ends 33, 34 of the blade 30. Alternatively, other attachments, e.g., an industrial adhesive, or sonic welding can be used to connect the end caps 70, 71 to the blades 30.

These hollow and closed or capped blades 30 have a relatively high "R" (insulation) value for energy efficiency. That is, each blade's R value might be about 1.6 or 1.7, as an example only.

As shown in FIGS. 12-17, each pivot mechanism 60 includes, in addition to an end cap 70, 71, a ballast bracket or arm 80, 81, respectively, that extends therefrom to receive a weight (described below) 100 to provide counter-balance for the blades 30. The ballast brackets 80, 81 are preferably made of metal. The left bracket 81 is essentially a mirror image of the right bracket 80 so only the right bracket 80 will be described below.

Figure 12:
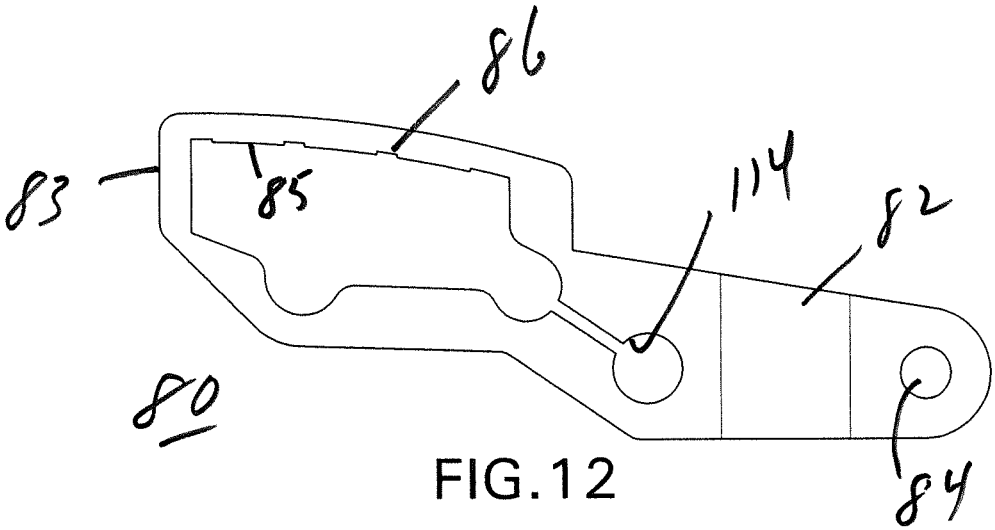
FIG. 12 is a side view of a ballast bracket.
Figure 13:
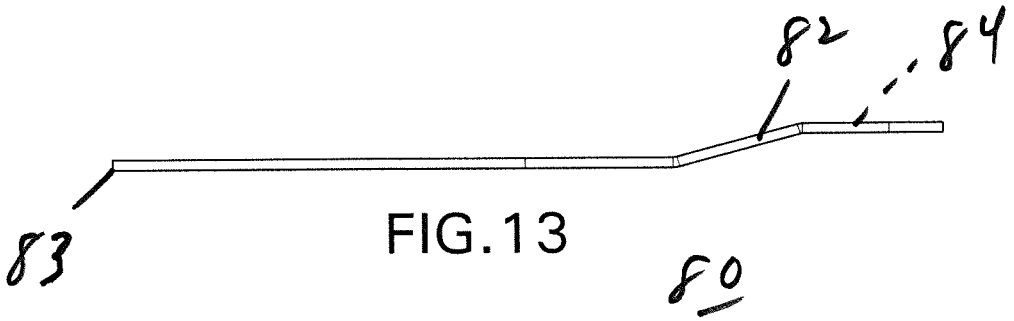
FIG. 13 is a top view of the ballast bracket shown in FIG. 12.

More particularly, FIG. 12 is a side view of a right ballast bracket 80 and FIG. 13 is a top view thereof. The bracket 80 is elongated and includes a first, leading end 82, which corresponds to the leading end 72 of the end cap 70, and a second, opposite, trailing end 83, which corresponds to the trailing end 73 of the end cap 70.

At the first end 82 there is a hole 84 that receives a removable connector 102 to secure the weight 100 to the ballast bracket 80. The connector 102 may be, e.g., a bolt/nut, rivet, etc. At the second end 83 there is an opening 85 to receive the projecting portion 76 of the end cap 80 therethrough. As shown in FIG. 12, the opening 85 is formed to include receptacles 86 to receive the ribs 68 discussed above therethrough.

The weights 100 are preferably made of metal and serve to facilitate easy movement of the blades 30 and avoid the need for an electric motor to return the blades 30 to a closed position from the open position, once the air pressure stops. Instead, the weights could be plastic molded members with, e.g., metal therein, to provide the weight.

The weight 100 can be removably connected to the bracket 80, 81. Alternatively, a weight 110 could be molded as part of the pivot mechanism 60 and would not be removable, as discussed below.

The end caps 70, 71/ballast brackets 80, 81/weights 100 can be configured to accommodate the mass distribution of a given blade 30 length. In this regard, in a preferred embodiment, each weight will be about 2.25 grams. However, the formula for determining the size of the weight or ballast for a particular size of blade is "Ballast=0.335 (g/in)×length of the blade." It is this weight that needs to be overcome in order to open the blade 30. In this regard, the airfoil design of the blade 30 facilitates the opening of the blade via changing air pressure against the effect of the weight.

Figure 14:
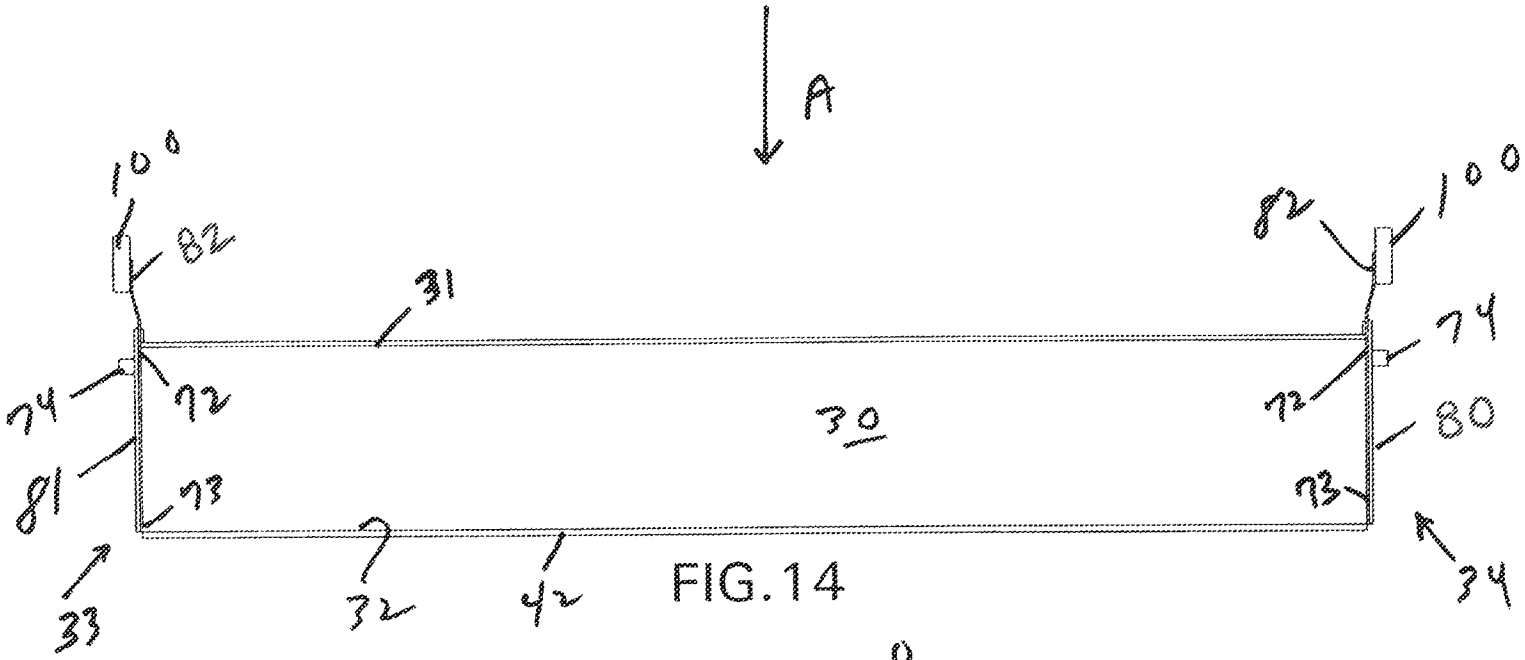
FIG. 14 is a top view of a blade according to the present invention with a pivot mechanism attached at ends thereof.
Figure 15:
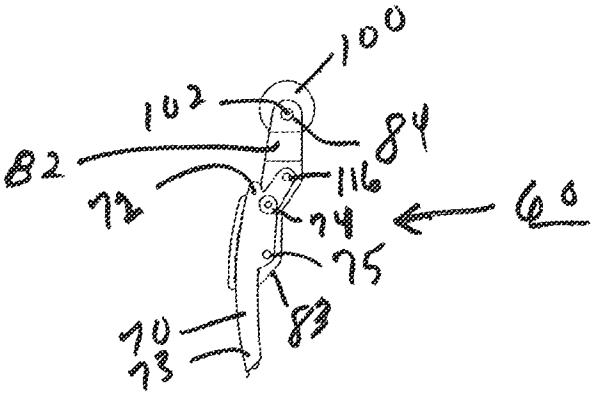
FIG. 15 is a right side view of the blade shown in FIG. 14.
Figure 16:
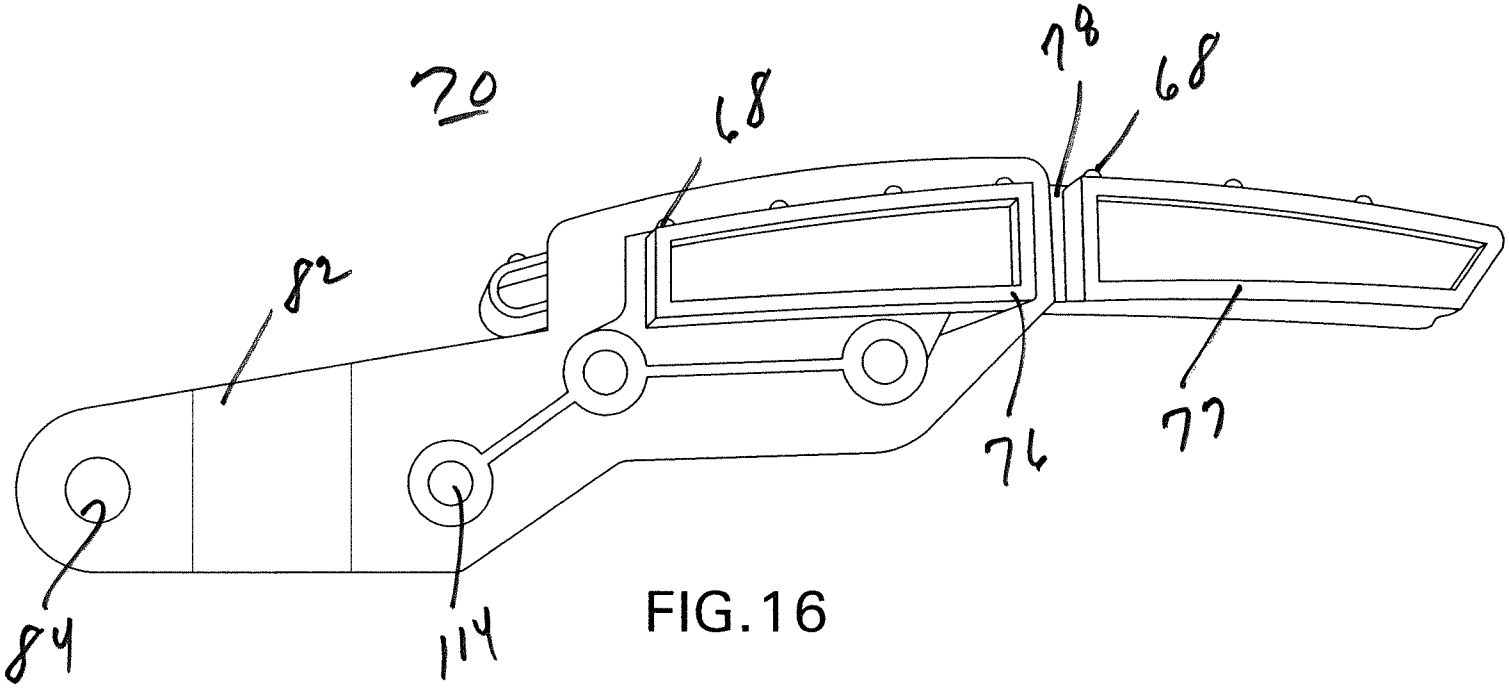
FIG. 16 is a left side view of the pivot mechanism shown in FIG. 15.

As can be seen from the embodiment shown in FIGS. 12 and 14, the first end 82 of the right ballast bracket 80 is bent to the outside (i.e., away from the blade 30 and toward the frame 20) so that the weight 100 and the connector 102 can clear the ladder bar 110 discussed below during movement of the blade 30.

Rivets, screws, etc., can also be used at the holes 75, if desired, to further secure the brackets 80, 91 to the end caps 70, 71.

Alternatively, and preferably, as shown in FIGS. 17*a*-17*e*, pivot mechanism 60 can be formed as one piece, including the weights 100, via molding.

Figure 17:
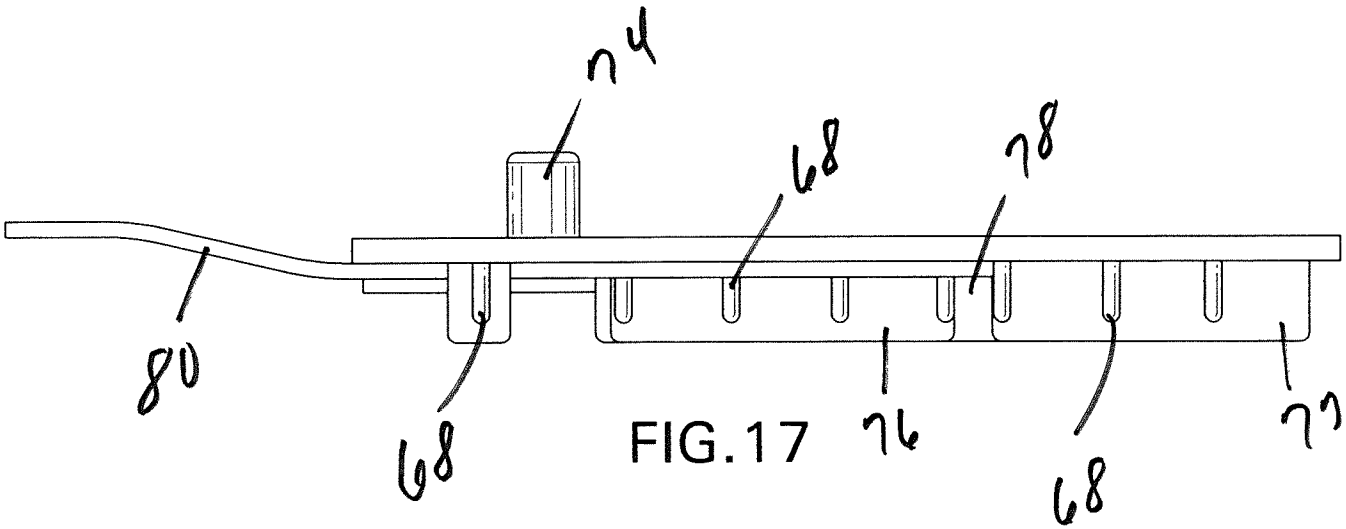
FIG. 17 is a top view of the pivoting mechanism shown in FIG. 15.
Figure 17A:
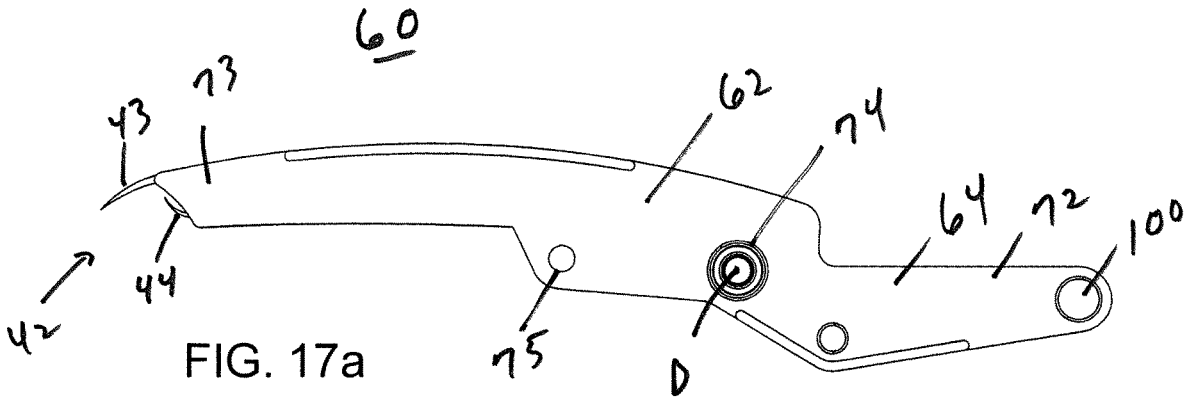
FIG. 17*a* is a side view of a right side one-piece pivot mechanism.
Figure 17B:
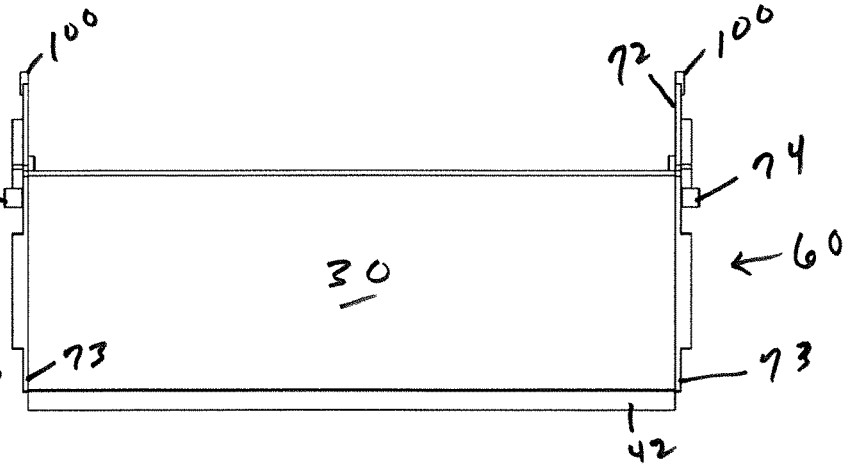
FIG. 17*b* is a top view of a blade including right and left one-piece pivot mechanisms like that shown in FIG. 17*a;*
Figure 17C:
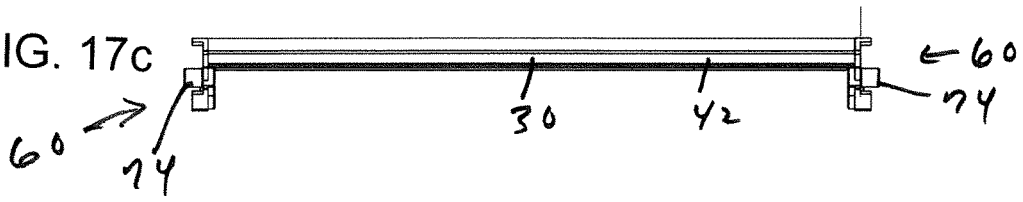
FIG. 17*c* is a front view of a blade including right and left one-piece pivot mechanisms like that shown in FIG. 17*a;*
Figure 17D:
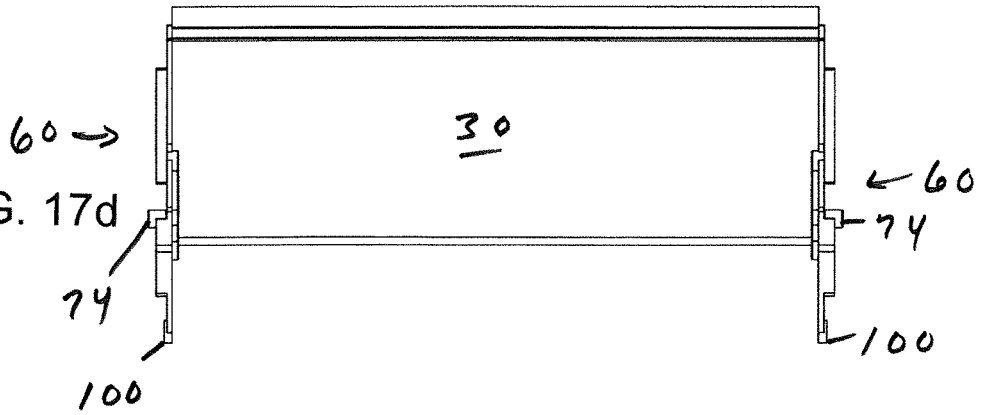
FIG. 17*d* is a bottom view of a blade including right and left one-piece pivot mechanisms like that shown in FIG. 17*a;*

FIG. 17*a* is a right side view of a one-piece pivot mechanism 60. The left one piece-pivot mechanism 60 is essentially the same so no detailed description thereof is necessary. FIG. 17*b* is a top view of a blade 30 including right and left one-piece pivot mechanism 60 like that shown in FIG. 17*a*. FIG. 17*c* is a front view of a blade 30 including right and left one-piece pivot mechanisms 60. Further, FIG. 17*d* is a bottom view of a blade 30 including right and left one-piece pivot mechanisms 60.

As shown in FIGS. 17*a*-17*d*, the pivot mechanism 60 does not use separate end caps 70, 71, ballast brackets 80, 81, and removable weights 100. Instead, the pivot mechanism 60 includes an elongated body 62 and an extension 64 formed at the leading edge 72 thereof. The weight 100 is preferably formed at the end of the extension 64. In this way, the trailing edge 73 of the blade 30 is of one weight and the extension 64 is of another, greater weight.

Again, the air pressure "A" must be sufficient to overcome the weighted extension 64 in order to allow the blade 30 to open. Of course, inset molding can be used, wherein the pivot mechanism 60 is molded around a weight 100, which may be a multiple of weights, or material of different weights used for the body 62 and the extension 64.

The entire pivot mechanism 60 can be formed as one piece, with the weight 100 being included therein. Alternatively, any of the components described above, e.g., the blades, end caps, seals, weights, etc., can be formed individually and mechanically combined or any number of the components can be combined as one-piece.

As noted above, the damper 10 utilizes a counterweight system to assist in the opening of the blades 30. In this regard, a pre-calculated set of weights 100 is attached to the leading edge 31 sides of the blades 30.

Thus, the present invention provides blades 30 that have pivot mechanisms 60, each with an extension on each leading edge 31 side to allow for the reception of the counter weights 100 to assist in the opening motion of the damper 10 under air pressure A.

Figure 18:
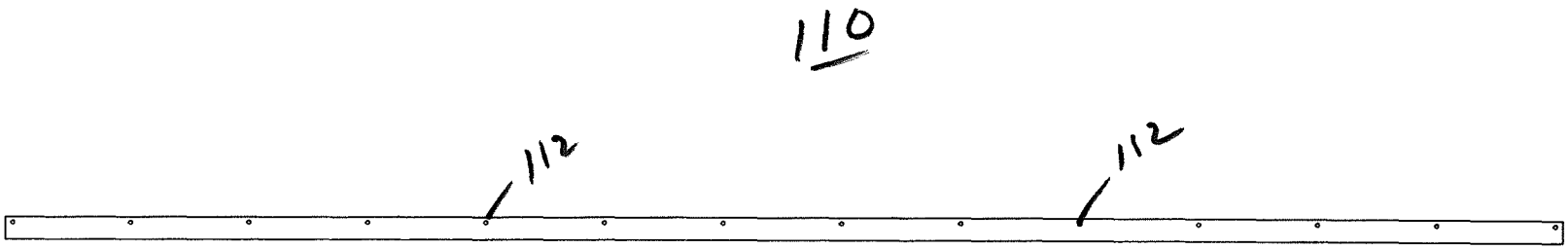
FIG. 18 is a plan view of a ladder bar.

As shown in FIG. 18, there is also included at least one elongated ladder bar 110 that connects all blades 30 together. The ladder bars 110 are preferably made of metal. That is, the ladder bar 110 includes holes 112 that align with holes 114 formed in the ballast brackets 80, 81 and holes 116 in the end caps 70, 71 (see FIG. 12) and are connected by a bolt, screw, washer, etc., so as to allow the blades 30 to move in unison via the ladder bar 110 from the closed to the open position and back.

One or more ladder bars 110 may be used. In the embodiment shown in FIG. 1B herein, a total of four ladder bars 110 are used, one at each end 33, 34 of the sets 30*a* and 30*b*.

Also, the ladder bar 110 can be used for "lock down" of the damper 10, e.g., during a winter season, when the fans won't be operating and the damper will not be opened, and/or for security reasons at any time of the year.

Figure 19:
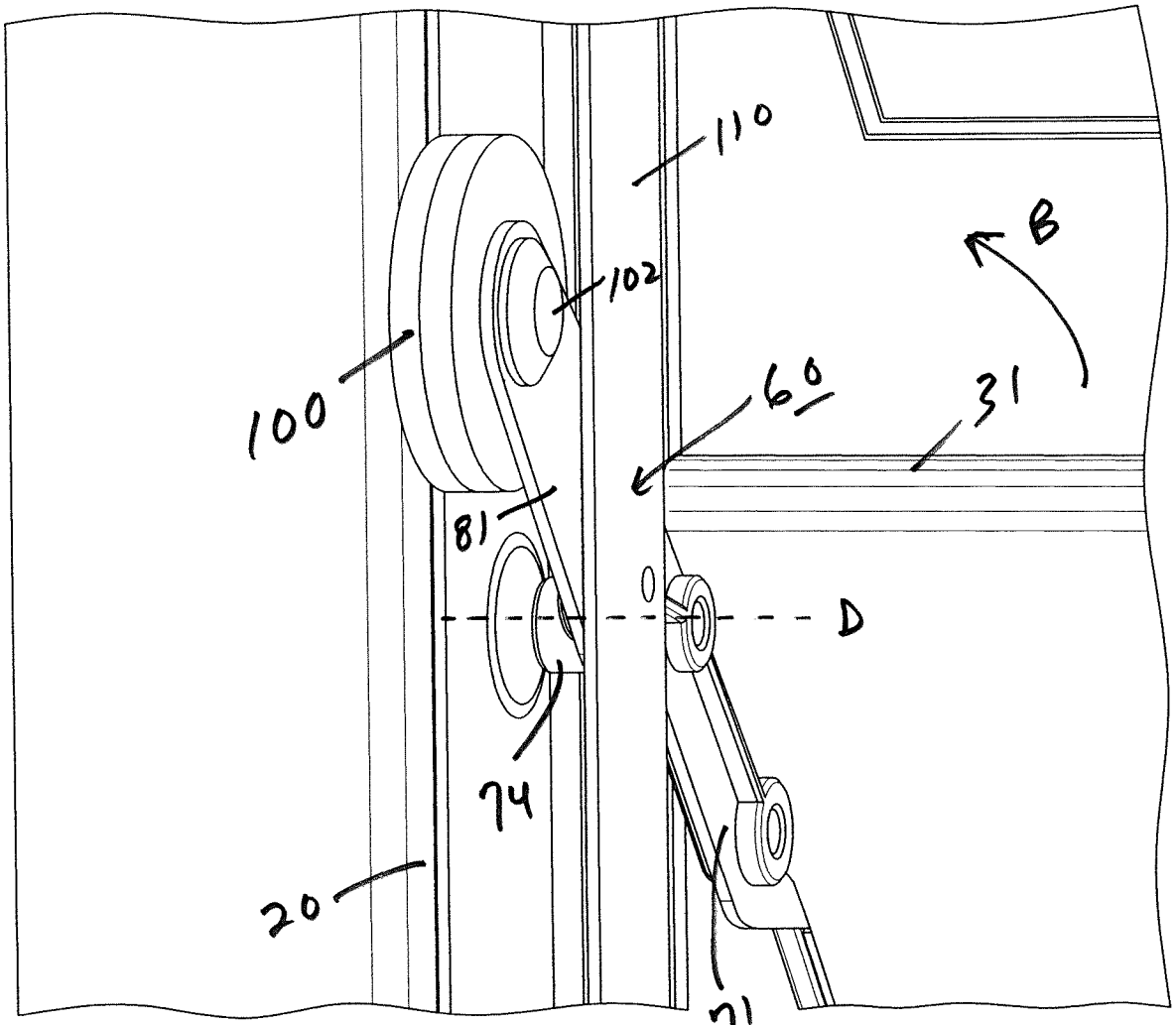
FIG. 19 is a perspective view of a leading edge of a blade, the pivot mechanism between the blade and frame, and a ladder bar pivotally attached to the pivot mechanism.
Figure 20:
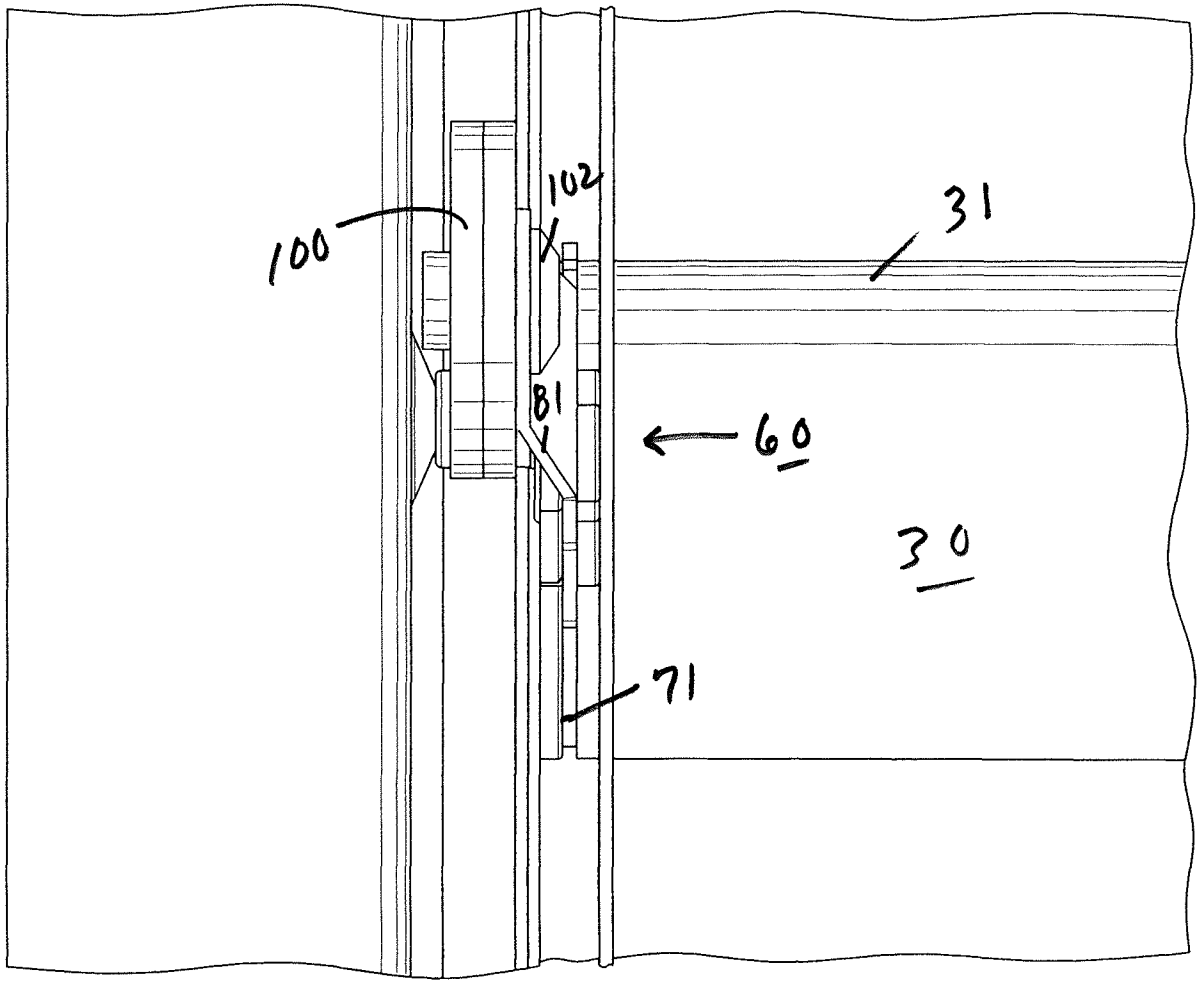
FIG. 20 is another view of a leading edge of a blade, the pivot mechanism between the blade and frame, and a ladder bar pivotally attached to the pivot mechanism.

FIGS. 19 and 20 show the leading edge 31 of the blade 30, the pivot mechanism 60 between the blade 30 and the frame 20, and a ladder bar 110 pivotally attached to the pivot mechanism 60. More particularly, there is shown the leading edge 31, left end cap 71, a left ballast bracket 81, and a ladder bar 110, with the blade 30 pivoting between closed and open positions. As can be seen, the ladder bar 110 is located inwardly relative to the end cap 71 and the ballast bracket 81, but the weight 100 is placed outwardly of the ladder bar 110. As noted above, the first end 82 of the ballast bracket 81 is bent outwardly relative to the ladder bar 110 for clearance of the weight 100.

Bushings, washers, lubricants, etc., can be provided at all pivot points, where necessary. Same facilitates movement of the damper 10 and reduces friction, especially over long-term use.

Any of the components noted above, especially the preferably plastic components like the blades 30 and end caps 70, 71, can be black for aesthetic purposes as well as to prevent light infiltration through the damper 10, when desired.

As described above, and as shown particularly in FIGS. 1A, 1B, 4, 6, 14, 19 and 20, the frame 20 forms the outside of the damper 10 and each vertical side of the frame 20 receives each blade end with a weight extending therefrom, all in a pivoting relation via the pivot mechanism 60. The ladder bar 110 is pivotally connected to the pivot mechanisms 60.

The blades 30 are usually oriented vertically relative to the frame 20, with the leading edge 31 of the uppermost blade 30" against the top 20*a* of the frame 20, and the trailing edge 32 of the uppermost blade 30" sealed against the leading edge 31 of the next lower blade 30 via the seal 42, and the trailing edge 32 of the next lower blade 30 against the leading edge 31 of the next lower blade 30, and so on, until the trailing edge 32 of the lowest most blade 30' seals against the wall 24. The ends of the blades 30 are sealed relative to the sides 20*c* and 20*d* of the frame by the felt seals 50. In this orientation, the damper 10 seals out air and light. Also, each weight 100 is positioned above the pivot point 74 near the frame 20.

When the air pressure A increases and moves against the airfoil shape of the blades 30, and is of an amount sufficient to counteract the weights, the blades 30 move from the vertical, overlapping orientation described above, wherein the weights 100 are near the frame 20, to a horizontal position, wherein the weights 100 are spaced from the frame 20 and the ladder bar 110 and relatively co-planar with the corresponding horizontal blade 30 to which it is attached. In the horizontal position, the air A is allowed to move between the spaced blades 30. As long as the air pressure is of an amount sufficient to overcome the affect of the weights, the airfoil blades stay in the relatively horizontal spaced position. When the air pressure A falls below this amount, the blades return to the original, vertical, overlapping position due to the weights.

In summary of the above, the present invention, in at least one embodiment, basically provides a damper that includes a frame and a plurality of hollow airfoil blades. Each blade has a leading edge, a trailing edge, a seal formed on the trailing edge, preferably by co-extrusion molding, and a pivot mechanism on either end of each blade. Each pivot mechanism includes an extension that includes a weight, either attached thereto or more preferably integrally formed therewith. A secondary seal is positioned between the pivot mechanisms and the sides of the frame. A ladder bar connects the pivot mechanisms so that the blades move in unison. At a significant enough change in air pressure, such as when a fan is turned on, and due to the airfoil shape, the affect of the weights is overcome, and the blades are caused to move from a first, closed, overlapping position relative to the frame, whereupon the seal on the trailing edge of a relatively upper blade seals against the leading edge of an adjacent relatively lower blade, and the secondary side frame seal seals against the pivot mechanisms, to a second, open position. The airfoil blades will stay in the second, open position as long as the air pressure is enough to overcome the affect of the weights. When the air pressure decreases below the amount of air pressure needed to overcome the affect of the weights, the blades return to the first, closed, overlapping position.

Based on the above-described structure and operation, the damper 10 according to the present invention saves energy due to less leakage of hot/cold air through the damper 10, improved insulation and the lack of any need for electricity to run a damper motor. Also, by not needing a motor, the construction is simpler, less costly to purchase and maintain, and more reliable. Further, the blades 30, each being a hollow but sealed member and being made from plastic, provide improved thermal insulation across the entire damper. The blades 30, along with the double seal 42 along the trailing edge 32 and the frame seals 50, reduce thermal, air and light leakage. Moreover, because each blade 30 is essentially removably mounted on the frame, it is easy to replace a damaged blade 30, change a weight 100, etc., if necessary.

While a preferred embodiment describes the use of a weight 100 on each pivot mechanism, the present invention should not be limited thereto. A weight 100 on only one of the end caps of each blade, weight(s) on every other blade end cap, or multiple weights on each end cap, may be suitable.

Further, while a preferred embodiment is described herein wherein a fan 14 is adjacent the damper 10, the invention is not limited thereto. That is, the damper 10 may be in one wall of a building and the fan(s) 14 may be in another wall, particularly is some horticultural or agricultural applications. In these cases, when the fan(s) is turned on, the damper 10 opens, as described above. Moreover, while the damper of this invention is described above for use in a building wall, the damper could be located elsewhere, e.g., in the roof of a building.

Moreover, while a preferred embodiment described above indicates the damper 10 is used with an electric fan, the damper according to the present invention provides benefits when there are changes in air pressure at the damper, e.g., from changing weather conditions, that are not caused by a fan. In this case, if the air pressure changes are adequate, the damper 10 still opens reliably. Thus, the present damper may be used whenever there is a desire to have a damper open when air pressure thereat changes enough pressure to open the damper blades against the weights 100, e.g., during tornado weather conditions. In any case, the airfoil design and counterweight system allows the blades to move under air pressure changes without an electric motor.

The foregoing is considered illustrative only of the principles of the invention. Further, since numerous modifications and changes will readily occur to those skilled in the art, it is not desired to limit the invention to the exact construction and operation shown and described. Accordingly, all suitable modifications and equivalents may be resorted to that fall within the scope of the invention and the appended claims.

What is claimed is:

1. A damper, comprising:

a frame having an air inlet side and an air outlet side; and a plurality of hollow blades, each having— a cross-section in a shape of an asymmetrical airfoil with a convexly-curved centerline, a leading edge, and a trailing edge, wherein the leading edge is a rounded surface against which the inlet side air moves, and the outlet side air moves against the trailing edge, top and bottom opposing surfaces between the leading edge and the trailing edge, wherein each top and bottom surface is continuously convexly curved along an entire length thereof from the leading edge to the trailing edge, a convex rib connecting portions of the opposing convexly-curved top and bottom surfaces at the trailing edge of each blade, wherein a first distance between the top and bottom surfaces at the convex rib is greater than a distance between the top and bottom surfaces adjacent the rounded leading edge, two opposing open ends, an end cap sealing each of the open ends, and on the trailing edge, a depressible seal parallel to the trailing edge, wherein each blade is pivotally connected to the frame by respective pivot mechanisms received at the ends, wherein each of the pivot mechanisms has a corresponding leading edge and trailing edge, wherein each leading edge of each pivot mechanism includes a ballast weight integrally connected to a front of the leading edge of the blade so that the leading edge of each pivot mechanism has a greater weight than the trailing edge of the blade, which weight is non-adjustably fixed to the pivot mechanism so that the weight cannot move relative to the pivot mechanism, wherein each pivot mechanism includes a pivot point that extends therethrough from the respective end cap close to the leading edge of each blade, and wherein the blades move from a first, closed position relative to the frame, where the leading edge of each of the blades and the weights are positioned above the respective pivot point, and the seal of the trailing edge of one of the blades seals against the leading edge of another blade or a bottom of the frame, to a second, open position relative to the frame, when a pressure of the inlet air at the leading edge of each of the blades and the top and bottom surfaces of each of the blades creates a lift in an amount sufficient to rotate the blades into the second, open position, and, when the lift falls below the amount sufficient, the blades move back to the first, closed position.

2. The damper according to claim 1, wherein the seal is first and second spaced, elongated seals that extend substantially along a length of the trailing edge of each of the blades.

3. The damper according to claim 1, wherein each weight is integrally molded with each of the pivot mechanisms, respectively, as one piece.

4. The damper according to claim 1, further comprising an insulative member between each pivot mechanism and the frame.

5. The damper according to claim 1, wherein each of the blades is extrusion molded with the seal.

6. The damper according to claim 1, further comprising:

at least one bar pivotally connecting the pivoting mechanisms so that the plurality of blades move between the first and second positions together.

7. The damper according to claim 1, wherein the ballast of the weight is equal to 0.335 (g/in) multiplied by a length of the blade.

8. The damper according to claim 1, wherein the insulative R value of each end capped blade is in the range of 1.6 to 1.7.

9. A damper, comprising:

a frame having an air inlet side and an air outlet side;

a plurality of hollow blades, each blade having— an asymmetrical airfoil shape with a convexly curved centerline, a leading edge, and a trailing edge, wherein the leading edge is a rounded surface against which the inlet air moves, and the outlet air moves against the trailing edge, top and bottom opposing surfaces between the leading edge and the trailing edge, wherein each top and bottom surface is continuously convexly curved along an entire length thereof from the leading edge to the trailing edge, a convex rib connecting portions of the opposing, convexly-curved top and bottom surfaces at the trailing edge of each blade, two opposing, open ends, an end cap closing each of the open ends, and first and second depressible, spaced seals that extend substantially along and parallel with the trailing edges of the blades, pivot mechanisms that have corresponding leading and trailing edges, that include extensions at the leading edges of the pivot mechanisms, and that include therethrough a pivot point extending from the respective end cab, which pivot points are received by the frame to allow the blades to pivot relative to the frame;

a ballast weight integrally connected at each leading edge extension, in front of the leading edge of each blade, to render the pivot mechanisms heavier at the leading edge thereof than at the trailing edges of the blades, which weight is non-adjustably fixed to the pivot mechanism so that the weight cannot move relative to the pivot mechanism;

wherein the pivot point is close to the leading edge of each blade; and at least one bar pivotally connecting the pivoting mechanisms so that the plurality of blades move together, wherein the blades move from a first, closed position relative to the frame, where the leading edge of each of the blades and the weights are positioned above the pivot point, to a second, open position relative to the frame, when a pressure of the inlet air at the leading edge of each blade and the asymmetrical top and bottom surfaces of each blade creates a lift in an amount sufficient to rotate the blades into the second, open position, and, when the lift falls below the amount sufficient, the blades move back to the first, closed position, wherein, when the blades are in the first, closed position, each weight is located above the respective pivot point, and, when the blades are in the second, open position, the leading edges of the blades face the inlet side and the trailing edges of the blades face the outlet side, and the blades are substantially horizontal with each weight being substantially co-planar with the respective pivot point, and wherein the seals abut a leading edge of an adjacent blade or a bottom of the frame when the blades are in the first, closed position.

10. The damper according to claim 9, wherein each blade is extrusion molded with the seals.

11. The damper according to claim 9, wherein each weight is integrally molded as one piece with the respective pivot mechanism.

12. The damper according to claim 9, wherein the insulative R value of each end capped blade is in the range of 1.6 to 1.7.

* * * * *